US011261042B2

(12) United States Patent
Noguchi

(10) Patent No.: US 11,261,042 B2
(45) Date of Patent: Mar. 1, 2022

(54) MEDIUM FEEDING APPARATUS

(71) Applicant: RISO KAGAKU CORPORATION, Tokyo (JP)

(72) Inventor: Yoshihiro Noguchi, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 198 days.

(21) Appl. No.: 16/686,563

(22) Filed: Nov. 18, 2019

(65) Prior Publication Data

US 2020/0247626 A1 Aug. 6, 2020

(30) Foreign Application Priority Data

Jan. 31, 2019 (JP) ..... JP2019-015900

(51) Int. Cl.

| | |
|---|---|
| ***B65H 1/14*** | (2006.01) |
| ***B65H 1/04*** | (2006.01) |
| ***B65H 3/06*** | (2006.01) |
| ***B65H 3/34*** | (2006.01) |
| ***B65H 1/10*** | (2006.01) |

(52) U.S. Cl.

CPC ..... *B65H 1/04* (2013.01); *B65H 1/10* (2013.01); *B65H 1/14* (2013.01); *B65H 3/06* (2013.01); *B65H 3/34* (2013.01); *B65H 2301/42324* (2013.01); *B65H 2801/06* (2013.01)

(58) Field of Classification Search

CPC ... B65H 1/04; B65H 1/10; B65H 1/14; B65H 23/16; B65H 1/18; B65H 1/20

See application file for complete search history.

(56) References Cited

U.S. PATENT DOCUMENTS

| | | | | |
|---|---|---|---|---|
| 5,294,105 | A * | 3/1994 | Kaburagi | G01D 15/28 271/157 |
| 5,988,629 | A * | 11/1999 | Burlew | B65H 1/14 271/152 |
| 7,922,169 | B2 * | 4/2011 | Mandel | B65H 3/0684 271/121 |
| 9,327,929 | B2 * | 5/2016 | Nishioka | B65H 3/54 |
| 2011/0024970 | A1 * | 2/2011 | Uchida | B65H 1/14 271/10.16 |

(Continued)

FOREIGN PATENT DOCUMENTS

| | | |
|---|---|---|
| JP | 57-90331 | 6/1982 |
| JP | 59-149834 | 10/1984 |

(Continued)

OTHER PUBLICATIONS

Chinese Office Action, Chinese Patent Office, Application No. 201911198850.6, dated Mar. 12, 2021, English translation.

(Continued)

*Primary Examiner* — Howard J Sanders

(74) *Attorney, Agent, or Firm* — Greenblum & Bernstein, P.L.C.

(57) ABSTRACT

A medium feeding apparatus includes: a feed tray on which media M are placed; a draw-out unit that draws out an uppermost medium among the media placed on the feed tray; a hanging member that hangs the feed tray; and a load member that applies, when an amount of the media placed on the feed tray is equal to or smaller than a predetermined amount, a downward load to a portion of the feed tray located on an upstream side in a draw-out direction of the media.

9 Claims, 10 Drawing Sheets

(56) References Cited

U.S. PATENT DOCUMENTS

| | | | | |
|---|---|---|---|---|
| 2017/0210577 | A1* | 7/2017 | Mori | B65H 3/0684 |
| 2020/0189865 | A1* | 6/2020 | Yamaguchi | B65H 11/00 |

FOREIGN PATENT DOCUMENTS

| | | |
|---|---|---|
| JP | 2001-192125 | 7/2001 |
| JP | 2001-206560 | 7/2001 |
| JP | 2009-220944 | 10/2009 |
| JP | 4855431 | 1/2012 |

OTHER PUBLICATIONS

Extended European Search Report issued in EP Patent App. No. 19215264.3 dated Jul. 1, 2020 (in English).

* cited by examiner

MEDIUM FEEDING APPARATUS

CROSS-REFERENCE TO RELATED APPLICATION

This application is based upon and claims the benefit of priority of the prior Japanese Patent Application No. 2019-015900, filed on Jan. 31, 2019, the entire contents of which are incorporated herein by reference.

FIELD

Aspects described herein are related to a medium feeding apparatus that includes a feed tray hung by a hanging member.

As a paper feeding apparatus installed integrally with, or separately from, an image formation apparatus such as a copying machine or a printer apparatus, a conventional paper feeding apparatus is known wherein a paper feed tray is hung by a plurality of wires, and the paper feed tray is lifted by spooling the wires concurrently with drawing out sheets so that the sheets can be drawn out at a fixed position.

As such a paper feeding apparatus, a paper feeding apparatus is proposed wherein a weight is attached directly to a paper feed mount so as to reduce unevenness of loads applied to a plurality of wires, thereby preventing the paper feed mount from inclining (e.g., Japanese Patent No. 4855431).

SUMMARY

In one aspect, a medium feeding apparatus includes: a feed tray on which media are placed; a draw-out unit that draws out an uppermost medium among the media placed on the feed tray; a hanging member that hangs the feed tray; and a load member that applies, when an amount of the media placed on the feed tray is equal to or smaller than a predetermined amount, a downward load to a portion of the feed tray located on an upstream side in a draw-out direction of the media.

The object and advantages of the invention will be realized by means of the elements and combinations particularly pointed out in the claims.

DESCRIPTION OF EMBODIMENTS

Figure 1:
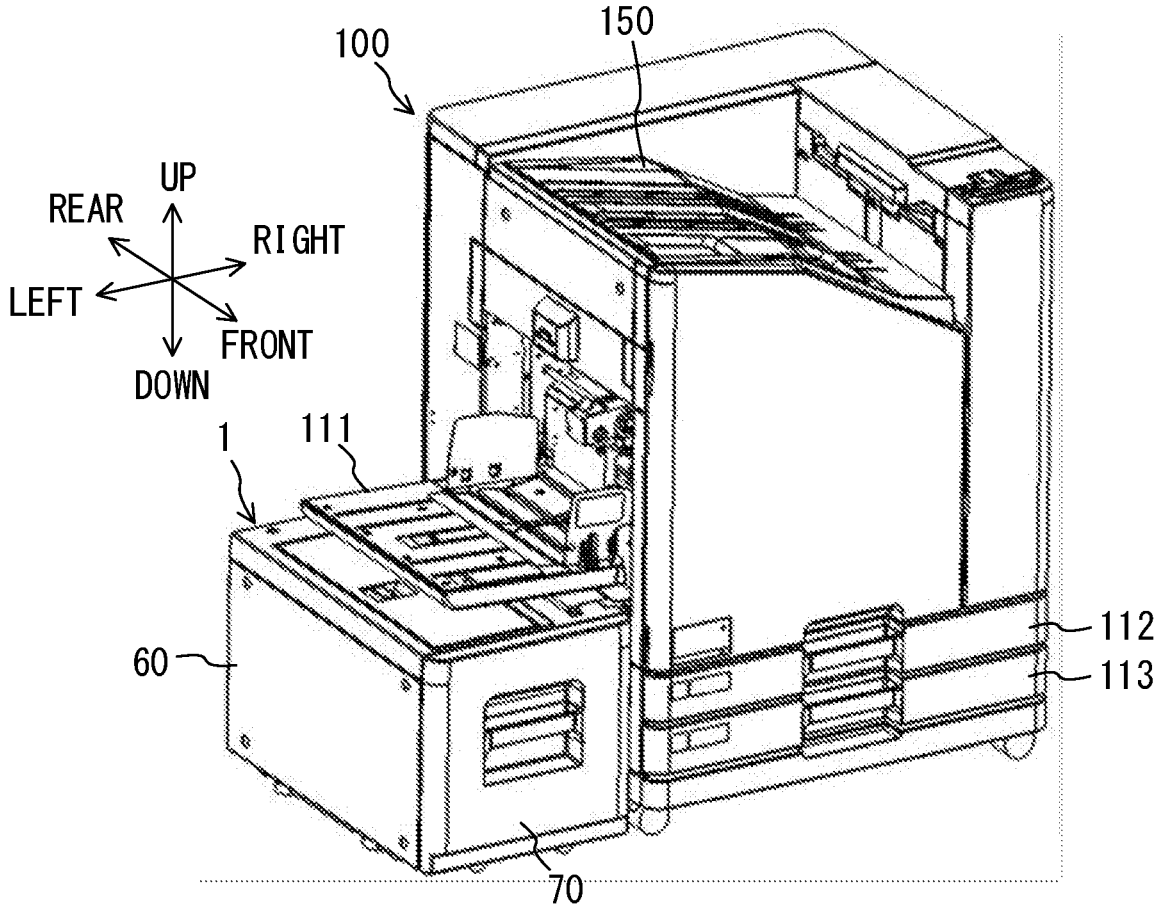
FIG. 1 is a perspective view illustrating a medium feeding apparatus in accordance with an embodiment and an image formation apparatus.

In the meantime, a medium feeding apparatus that feeds media such as sheets is such that a downward load from a draw-out roller for drawing out an uppermost medium is applied to a feed tray on which media are placed. As the number of media placed on the feed tray decreases, the load will be applied intensively to, from among four line members (hanging members) such as wires located on the front, rear, right, and left sides, the two line members located on the downstream side in the draw-out direction. Accordingly, the feed tray will be inclined in a manner such that the portions thereof on the upstream side in the draw-out direction are located at a higher position than the portions thereof on the downstream side in the draw-out direction. The inclination of the feed tray will make the performance of the feeding of media unstable.

Especially when the feed tray can be pulled out, the line members are not attached to the four corners of the feed tray but to portions of thereof such that the line members and the draw-out roller do not interfere with each other. Hence, the feed tray inclines more easily.

Meanwhile, a paper feeding apparatus that includes a paper feed mount to which a weight is directly attached as described above is such that a burden resulting from the weight is always applied to the paper feed mount, thereby imposing a large burden on a motor (drive means) for a spooling unit for spooling wires. Accordingly, the drive means will be large-sized, and the paper feed tray cannot be lifted or lowered at an increased rate.

The following describes a medium feeding apparatus in accordance with embodiments of the present invention by referring to the drawings.

An Embodiment

FIG. 1 is a perspective view illustrating a medium feeding apparatus 1 in accordance with an embodiment and an image formation apparatus 100.

Figure 2:
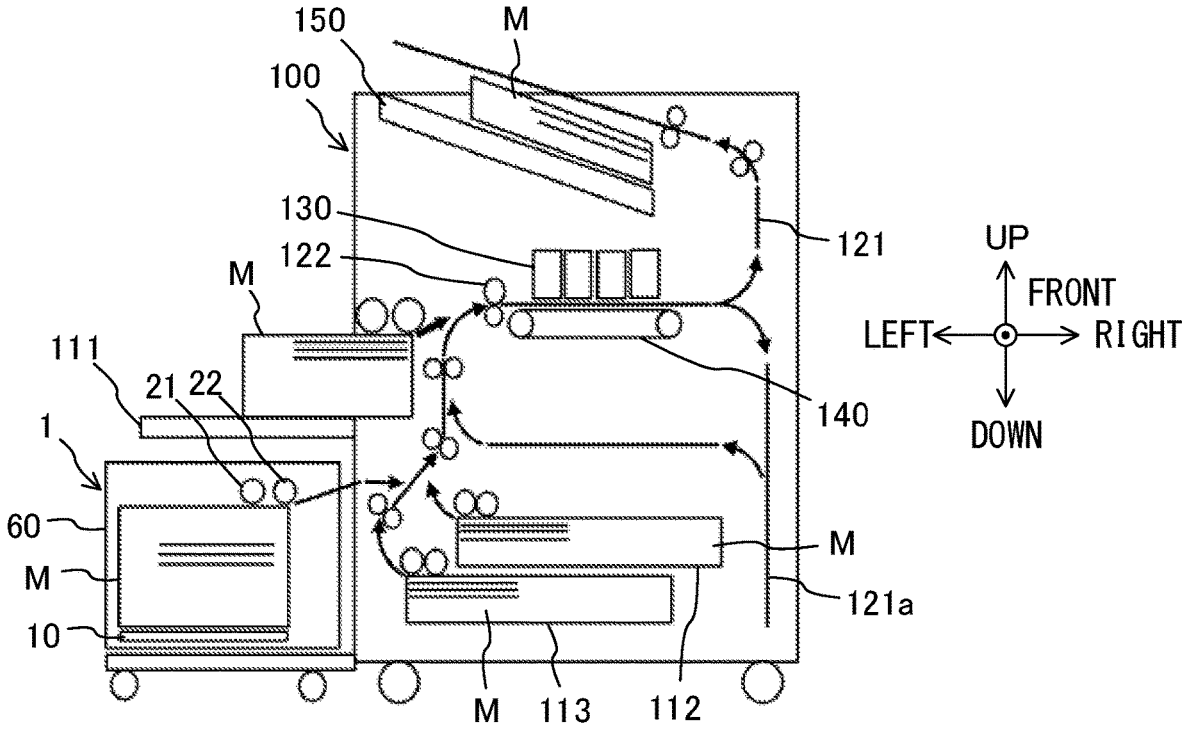
FIG. 2 is a front view illustrating the internal structures of a medium feeding apparatus in accordance with an embodiment and an image formation apparatus.

FIG. 2 is a front view illustrating the internal structures of the medium feeding apparatus 1 and the image formation apparatus 100.

The up-down, front-rear, and left-right directions indicated in FIGS. 1 and 2 and FIGS. 3-10, which will be referred to hereinafter, are defined for the purpose of illustration. For example, the up-down direction may be a vertical direction, and the front-rear direction and the left-right direction may be horizontal directions.

As depicted in FIGS. 1 and 2, the medium feeding apparatus 1 is connected to the image formation apparatus 100 and feeds media M depicted in FIG. 2 to the image formation apparatus 100. For example, media M may be flat paper sheets. The medium feeding apparatus 1 may be provided integrally with the image formation apparatus 100.

As depicted in FIG. 2, the image formation apparatus 100 includes a first paper feed tray 111, a second paper feed tray 112, a third paper feed tray 113, transportation paths 121, a plurality of transportation rollers 122, a printing unit 130, an attraction transportation unit 140, and a paper ejection tray 150.

The first paper feed tray 111 is disposed on the left side surface of the image formation apparatus 100 and located above the medium feeding apparatus 1. The second paper feed tray 112 and the third paper feed tray 113 are disposed within the image formation apparatus 100. Media M are placed on the first paper feed tray 111, the second paper feed tray 112, and the third paper feed tray 113.

The transportation paths 121 are paths on which media M are transported. FIG. 2 depicts the transportation paths 121 by using solid arrows, as appropriate. The transportation paths 121 include an inverting path 121*a* that inverts a medium M for both-side printing.

For example, the printing unit 130 may include a line-head-type inkjet head (not illustrated) for colors to be used for printing. The printing unit 130 may use printing schemes other than the inkjet printing scheme.

The attraction transportation unit 140 is positioned to face the printing unit 130. The attraction transportation unit 140 transports a medium M by means of a transportation belt while attracting this medium thereto. The attraction transportation unit 140 is an example of a transportation means for transporting a medium M.

The paper ejection tray 150 is disposed on an upper portion of the image formation apparatus 100 and has media M that have undergone printing placed thereon.

The configuration of the image formation apparatus 100 described above is nothing but an example, and an apparatus to which the medium feeding apparatus 1 feeds media M is not particularly limited. Meanwhile, the medium feeding apparatus 1 and the image formation apparatus 100 may be collectively referred to as a printing system. In other words, the printing system includes the medium feeding apparatus 1 and the image formation apparatus 100.

Figure 3:
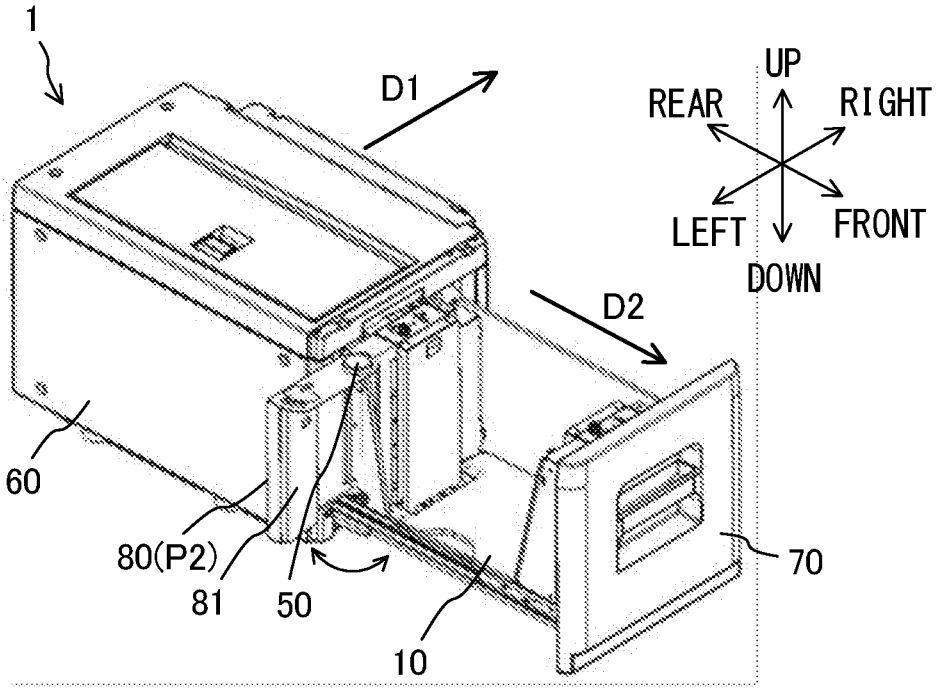
FIG. 3 is a perspective view illustrating a medium feeding apparatus in accordance with an embodiment with a pull-out part in a pulled-out state.

FIG. 3 is a perspective view illustrating the medium feeding apparatus 1 with a pull-out part 70 in a pulled-out state.

Figure 4A:
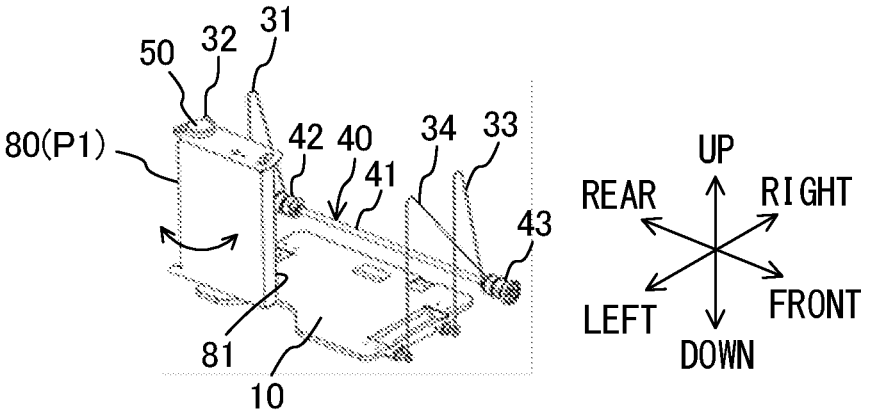
FIG. 4A is a perspective view illustrating the internal structure of a medium feeding apparatus in accordance with an embodiment (example 1)
Figure 4B:
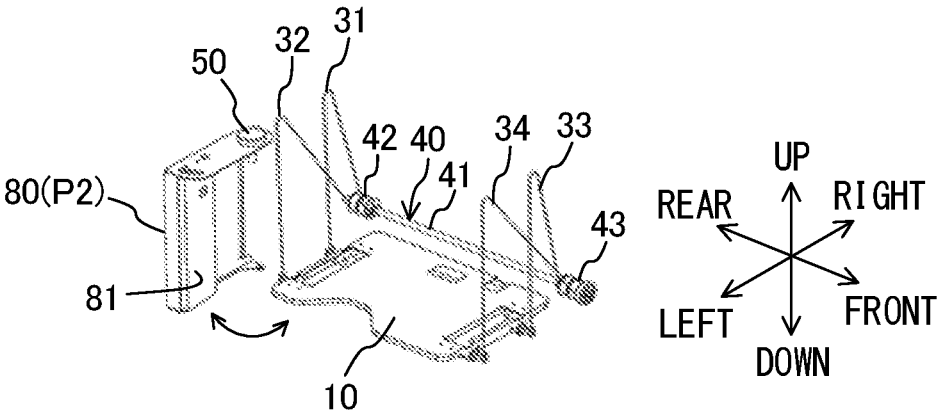
FIG. 4B is a perspective view illustrating the internal structure of a medium feeding apparatus in accordance with an embodiment (example 2)

FIGS. 4A and 4B illustrate the internal structure of the medium feeding apparatus 1.

As depicted in FIGS. 3, 4A, and 4B, the medium feeding apparatus 1 includes a feed tray 10, draw-out rollers 21 and 22 (see FIG. 2), first to fourth wires 31 to 34, a spooling unit 40, and a load member 50. The medium feeding apparatus 1 may also include a housing 60, the pull-out part 70, and a restriction member 80.

As depicted in FIG. 2, media M are placed on the feed tray 10.

The draw-out roller 21 among the draw-out rollers 21 and 22 depicted in FIG. 2 draws out the uppermost medium M placed on the feed tray 10, and the draw-out roller 22 transports the medium M drawn out by the draw-out roller 21 in a draw-out direction D1 (rightward direction) depicted in FIG. 3 toward the image formation apparatus 100. The draw-out rollers 21 and 22 are examples of a draw-out unit. The draw-out unit may be a draw-out belt.

The first to fourth wires 31 to 34 depicted in FIGS. 4A and 4B are examples of a plurality of line members that hang the feed tray 10. The first wire 31 is attached to a right rear portion of the feed tray 10. The second wire 32 is attached to a left rear portion of the feed tray 10. The third wire 33 is attached to a right front portion of the feed tray 10. The fourth wire 34 is attached to a left front portion of the feed tray 10. The plurality of line members (first to fourth wires 31 to 34) are examples of a hanging member that hangs the feed tray 10. Members other than the line members may be used as the hanging member.

As indicated in FIG. 3, the feed tray 10, the first to fourth wires 31 to 34, the spooling unit 40, the load member 50, and the restriction member 80 can be pulled out of the housing 60 in a pull-out direction D2 (forward direction) together with the pull-out part 70. Thus, the first and third wires 31 and 32, which are located on the downstream side (right side in FIG. 3) in the draw-out direction D1, are not attached to right edge portions of the feed tray 10, thereby avoiding interference with the draw-out rollers 21 and 22 depicted in FIG. 2. In this way, the first to fourth wires 31 to 34 are not attached to the four corners of the feed tray 10.

The spooling unit 40 depicted in FIGS. 4A and 4B includes a spooling shaft 41 and spooling pulleys 42 and 43 and spools the first to fourth wires 31 to 34. The spooling unit 40 is an example of a drive means for driving the first to fourth wires 31 to 34 (hanging member).

The spooling shaft 41 is rotated by an actuator (not illustrated) such as a motor so as to spool or unspool the first to fourth wires 31 to 34.

The spooling pulley 42 among the spooling pulleys 42 and 43 is located at the rear end, i.e., one end, of the spooling shaft 41 and has the first and second wires 31 and 32 wound thereupon. The spooling pulley 43 is located at the front end, i.e., the other end, of the spooling shaft 41 and has the third and fourth wires 33 and 34 wound thereupon.

The spooling shaft 41 and the spooling pulleys 42 and 43 of the spooling unit 40 are located on the downstream side in the draw-out direction D1 with reference to the feed tray 10. The first to fourth wires 31 to 34 are disposed in a manner such that these wires extend upward from the spooling pulleys 42 and 43, are hung over pulleys (not illustrated) disposed above the feed tray 10, and extend therefrom vertically downward to the feed tray 10.

Figure 5A:
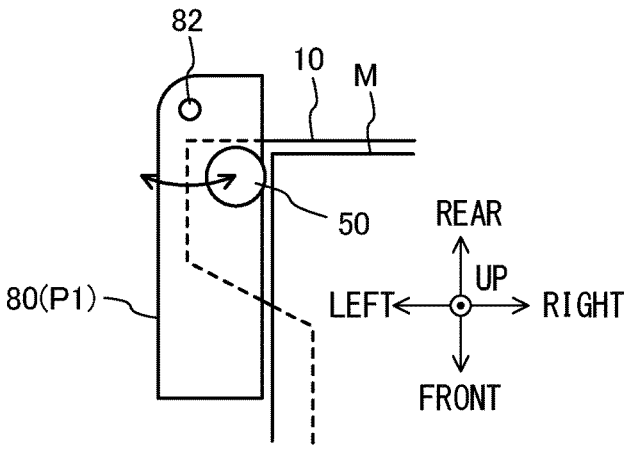
FIG. 5A is a plan view for illustrating a load member in an embodiment (example 1)
Figure 5B:
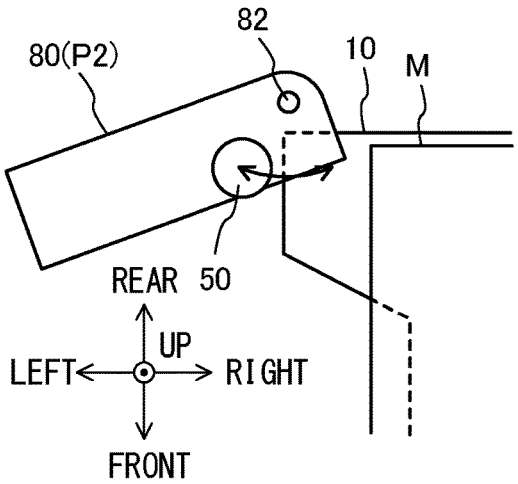
FIG. 5B is a plan view for illustrating a load member in an embodiment (example 2)

FIGS. 5A and 5B are plan views for illustrating the load member 50.

Figure 6A:
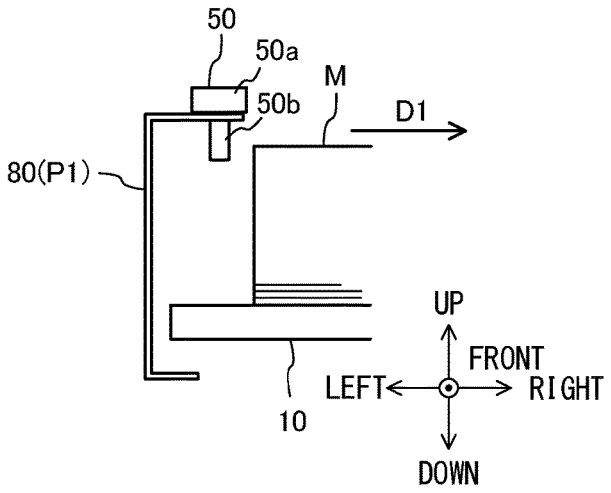
FIG. 6A is a front view for illustrating a load member in an embodiment (example 1)
Figure 6B:
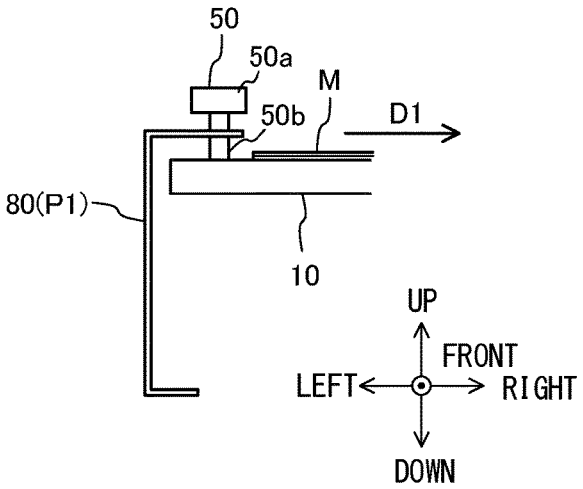
FIG. 6B is a front view for illustrating a load member in an embodiment (example 2)

FIGS. 6A and 6B are front views for illustrating the load member 50.

As depicted in FIGS. 3, 4A, 4B, 5A, 5B, 6A, and 6B, the load member 50 is provided at the restriction member 80. The restriction member 80 is an end fence for restricting the position of an edge portion of a medium M placed on the feed tray 10, the edge portion being one on the upstream side in the draw-out direction D1 (the left edge in the figures). The load member 50 may not be provided at the restriction member 80 but at a restriction member (side fence) for restricting the position of media M in the width direction (the front-rear direction in the figures). This restriction member (side fence) and the restriction member 80 are examples of a restriction member for restricting the position of an edge portion of the feed tray 10. The load member 50 may be disposed directly on an upper portion of the housing 60 or indirectly on the same via, for example, a member such as an arm. In this way, the load member 50 may be disposed on a member separate from the restriction member 80.

When the pull-out part 70 is accommodated within the housing 60, the load member 50 is, as depicted in FIGS. 4A, 5A, 6A, and 6B, located at a position above the feed tray 10 where the housing 60 applies a load to the feed tray 10. When the pull-out part 70 is accommodated within the housing 60, the restriction member 80 is located at a close position P1 where the restriction member 80 restricts, by means of an abutting section 81, the position of the edge portion of the media M located on the upstream side in the draw-out direction D1. When the restriction member 80 is at the close position P1, the load member 50 is located above a left rear portion of the feed tray 10, as depicted in FIG. 5A. However, as long as a downward load can be applied to the portion of the feed tray 10 located on the upstream side in the draw-out direction D1 (the upstream side with reference to the center of the feed tray 10 in the draw-out direction D1) when the restriction member 80 is at the close position P1, the load member 50 may be located above a left front portion of the feed tray 10, or two load members 50 may be disposed above a left rear portion and left front portion of the feed tray 10.

When the pull-out part 70 has been pulled out of the housing 60 in the pull-out direction D2 (forward direction) as depicted in FIG. 3, the load member 50 can be moved together with the restriction member 80 to an open position P2 to open an addition access path (the leftward direction opposite to the draw-out direction D1 depicted in FIG. 3) for allowing the user to add media M to the feed tray 10 as depicted in FIGS. 3, 4B, and 5B, the open position P2 being a position retracted from the close position P1 of the restriction member 80. The load member 50 and the restriction member 80 are rotationally moved with a rotating shaft 82 depicted in FIGS. 5A and 5B as a rotation center.

For example, the above-described movement of the load member 50 and the restriction member 80 may be achieved in a manual manner. The restriction member 80 may include a fixing means such as a magnet and may be fixed to the pull-out part 70 by this fixing means when being located at the close position P1. The load member 50 and the restriction member 80 may be biased to move to the open position P2 by a biasing mechanism, e.g., a torsion spring, provided at the rotating shaft 82, and the pull-out part 70 may be accommodated in the housing 60 against the biasing force of the biasing mechanism, thereby causing the load member 50 and the restriction member 80 to move to the close position P1.

The load member 50 is placed on an upper portion of the restriction member 80, as depicted in FIG. 6A, and comes into contact with the upper surface of the feed tray 10 when the load member 50 is located at the close position P1 and the feed tray 10 is lifted to a predetermined height (see FIG. 6B) or greater. The feed tray 10 may reach the predetermined height when the amount of media M placed on the feed tray 10 is equal to or less than half of the upper limit or desirably when the number of media M has been decreased to a few or several tens. Accordingly, the load member 50 may be in contact with the feed tray 10 when the amount of media M placed on the feed tray 10 is equal to or smaller than a predetermined amount. For the present embodiment, a condition (situation) in which the feed tray 10 has been lifted to the predetermined height or greater is described herein as an exemplary situation in which the amount of media M placed on the feed tray 10 is equal or smaller than the predetermined amount. For example, whether the amount of media M placed on the feed tray 10 is equal to or smaller than the predetermined amount may be determined by counting the number of media M on the feed tray 10 that would be decreased from the initial setting count every time printing (drawing out) is performed or may be determined on the basis of the weight of media M by using a means for measuring the weight of media M on the feed tray 10. When such a determination is made, a control operation may be performed to move the load member 50 to a position where the load member 50 applies a load to the feed tray 10 when the amount of media M placed on the feed tray 10 has become the predetermined amount or smaller.

The load member 50 is a weight that includes, for example, a head section 50*a* and an axis section 50*b*, wherein the head section 50*a*, which has a larger diameter than the axis section 50*b*, may be placed on an upper portion of the restriction member 80, and the axis section 50*b* extends downward from the head section 50*a* through the upper portion of the restriction member 80. Hence, when the feed tray 10 comes into contact with the load member 50 and is further raised, the load member 50 will be lifted by the feed tray 10. Accordingly, a load that corresponds to the weight of the load member 50 (weight) will be applied to the feed tray 10.

Figure 7A:
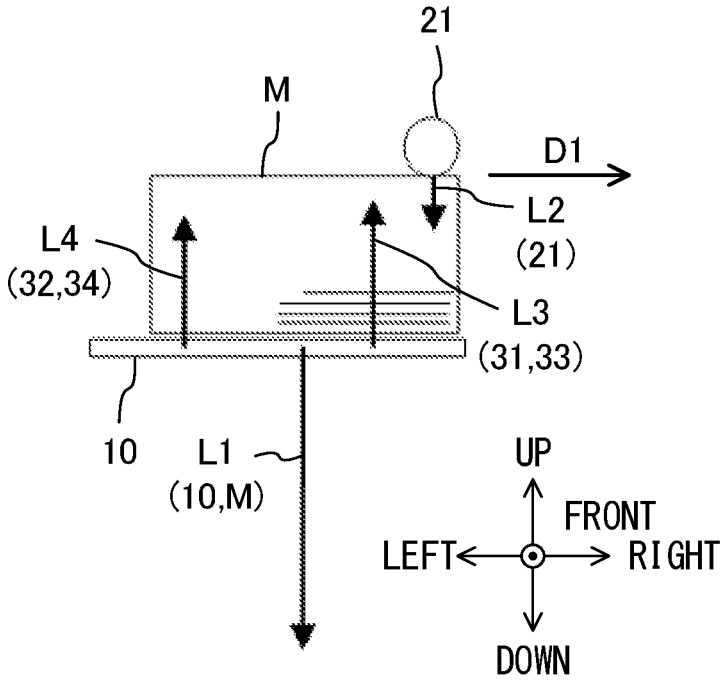
FIG. 7A is a front view for illustrating a relationship between loads applied to a feed tray in an embodiment (example 1)
Figure 7B:
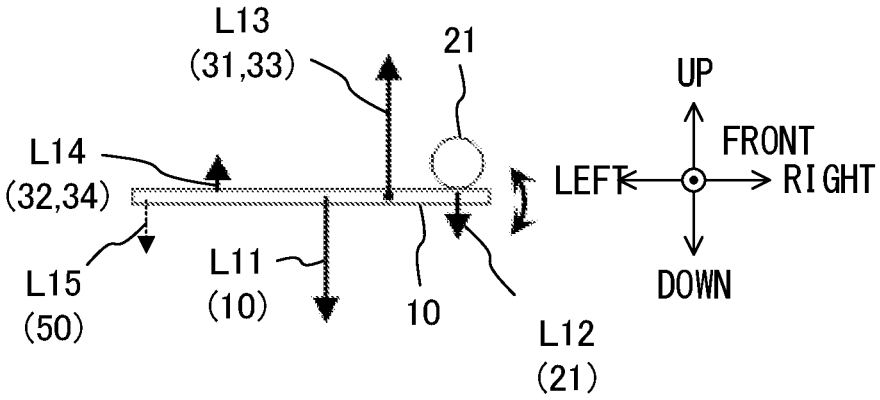
FIG. 7B is a front view for illustrating a relationship between loads applied to a feed tray in an embodiment (example 2)

FIGS. 7A and 7B are front views for illustrating a relationship between loads applied to the feed tray 10.

As depicted in FIG. 7A, when a large amount of media M is placed on the feed tray 10, the feed tray 10 receives a downward load L1 resulting from the weight of the feed tray 10 and the weight of the media M and a downward load L2 resulting from the draw-out rollers 21. The feed tray 10 also receives an upward load L3 resulting from the first wire 31 and the third wire 33 and a load L4 resulting from the second wire 32 and the fourth wire 34.

As depicted in FIG. 7B, when no media M (or a small amount of media M) are placed on the feed tray 10, the feed tray 10 receives a downward load L11 resulting from the weight of the feed tray 10 (and the weight of a small amount of media M, if any) and a downward load L12 resulting from the draw-out rollers 21. The feed tray 10 also receives an upward load L13 resulting from the first wire 31 and the third wire 33 and a load L14 resulting from the second wire 32 and the fourth wire 34.

As more media M are drawn out, the downward load L11 is decreased in comparison with the load L1 depicted in FIG. 7A. Thus, the total of the upward loads L13 and L14 becomes lower than the total of the loads L3 and L4, and the upward load L14 becomes lower than the upward load L13 (the first wire 31 and the third wire 33), which is located near the draw-out rollers 21. Accordingly, the feed tray 10 would be easily inclined in a manner such that the left side thereof (the upstream side in the draw-out direction D1 depicted in FIG. 3) is raised with the first wire 31 and the third wire 33 as fulcrums.

In this regard, the present embodiment is such that the load member 50 can apply a downward load L15 (dashed arrow) to the left-edge side of the feed tray 10 (the upstream side in the draw-out direction D1) and thus reduce the difference between the loads L13 and L14, thereby minimizing the inclination of the feed tray 10.

In the embodiment described above, the medium feeding apparatus 1 includes: the feed tray 10, on which media M are placed; the draw-out rollers 21 and 22, which are examples of the draw-out unit that draws out an uppermost medium M among the media M placed on the feed tray 10; the first to fourth wires 31 to 34, which are examples of the hanging member (a plurality of line members) that hangs the feed tray 10; and the load member 50, which applies, when the amount of the media M placed on the feed tray 10 is equal to or smaller than a predetermined amount, a downward load to a portion of the feed tray 10 located on the upstream side in the draw-out direction D1 of the media M.

In the meantime, when a large amount of media M is placed on the feed tray 10, the load L13 resulting from the first wire 31 and the third wire 33 attached to the portions of the feed tray 10 located on the downstream side (the right side in the figures) in the draw-out direction D1 and the load L14 resulting from the second wire 32 and the fourth wire 34 attached to the portions of the feed tray 10 located on the upstream side (the left side in the figures) in the draw-out direction D1 become essentially equal. However, when the amount of media M is placed on the feed tray 10 becomes small, the upward load L13 resulting from the first wire 31 and the third wire 33 located on the downstream side in the draw-out direction D1 would be concentrated on the feed tray 10 due to the downward load L12 resulting from the draw-out rollers 21 and 22, and the feed tray 10 would be inclined with the portion thereof located in the upstream side in the draw-out direction D1 being raised. In this regard, the present embodiment is such that the load member 50 can apply a downward load to the portion of the feed tray 10 located on the upstream side in the draw-out direction D1 and thus cancel out the downward load L12 resulting from the draw-out rollers 21 and 22, thereby preventing the feed tray 10 from inclining. In addition, the load member 50 applies the load with the feed tray 10 lifted to a predetermined height or greater, so that the load applied to the spooling unit 40 can be prevented from increasing in comparison to if the load member 50 was fixed to the feed tray 10.

Accordingly, the present embodiment is such that the feed tray 10 can be prevented from inclining and an increase in the load applied to the spooling unit 40 (an example of the drive means) that spools the first to fourth wires 31 to 34, i.e., examples of the hanging member, can be minimized. Hence, the actuator for the spooling unit 40, such as a motor, does not need to be large-sized, and the feed tray 10 can be lifted or lowered at an increased rate.

In the present embodiment, the hanging member that hangs the feed tray 10 is the first to forth wires 31 to 34, i.e., examples of the plurality of line members; the medium feeding apparatus 1 further includes the spooling unit 40, which spools the first to forth wires 31 to 34; and the load member 50 applies a load to the portion of the feed tray 10 located on the upstream side in the draw-out direction D1 when the feed tray 10 is lifted to a predetermined height or greater as a result of the spooling unit 40 spooling the first to forth wires 31 to 34. Accordingly, the feed tray 10 can be lifted in a simple configuration in which the first to forth wires 31 to 34, i.e., examples of the plurality of line members, are used, and the load member 50 can apply a load to the feed tray 10 without a means for determining whether the amount of placed media M is equal to or smaller than a predetermined amount (e.g., a means for counting the number of placed media M, a means for measuring the weight of media M).

The present embodiment is provided with a weight because the load member 50 is a weight. The load member 50, i.e., a weight, is positioned to come into contact with the feed tray 10 when the feed tray 10 lifted to a predetermined height or greater. When the feed tray 10 comes into contact with the load member 50 and is further lifted, the load member 50 (weight) will be raised by the feed tray 10. Accordingly, a constant downward load can be applied to the feed tray 10 when the feed tray 10 is in contact with the load member 50.

In the present embodiment, the medium feeding apparatus 1 further includes the restriction member 80 (an example of the restriction member), which can move to the open or close position (close position P1 or open position P2); the restriction member 80 restricts, when being located at the close position P1, the position of the upstream-side edge portion (an example of the edge portion) of a medium M placed on the feed tray 10 and opens, when being located at the open position P2, an addition access path for allowing media M to be added to the feed tray 10; and the load member 50 is provided at the restriction member 80. Accordingly, since the load member 50 is provided at the restriction member 80, a member for making the load member 50 fixed does not need to be further provided. Hence, the medium feeding apparatus 1 can have a simple configuration. Meanwhile, the restriction member 80 can move to the close position P1 or the open position P2; thus, the load member 50 can apply a downward load to the portion of the feed tray 10 located on the upstream side in the draw-out direction D1 with the action of adding media M interfered with when the restriction member 80 is located at the close position P1, and, during the action of adding media M, the load member 50 and the restriction member 80 can be retracted to a position where they do not interfere with the action of adding media M.

Another Embodiment

The present embodiment is different from the above-described embodiment only in that a load member 91 that includes an elastic member 91*a* is provided in place of the load member 50, i.e., a weight, and otherwise can be similar to the above-described embodiment. Accordingly, detailed descriptions of the present embodiment are omitted herein.

Figure 8A:
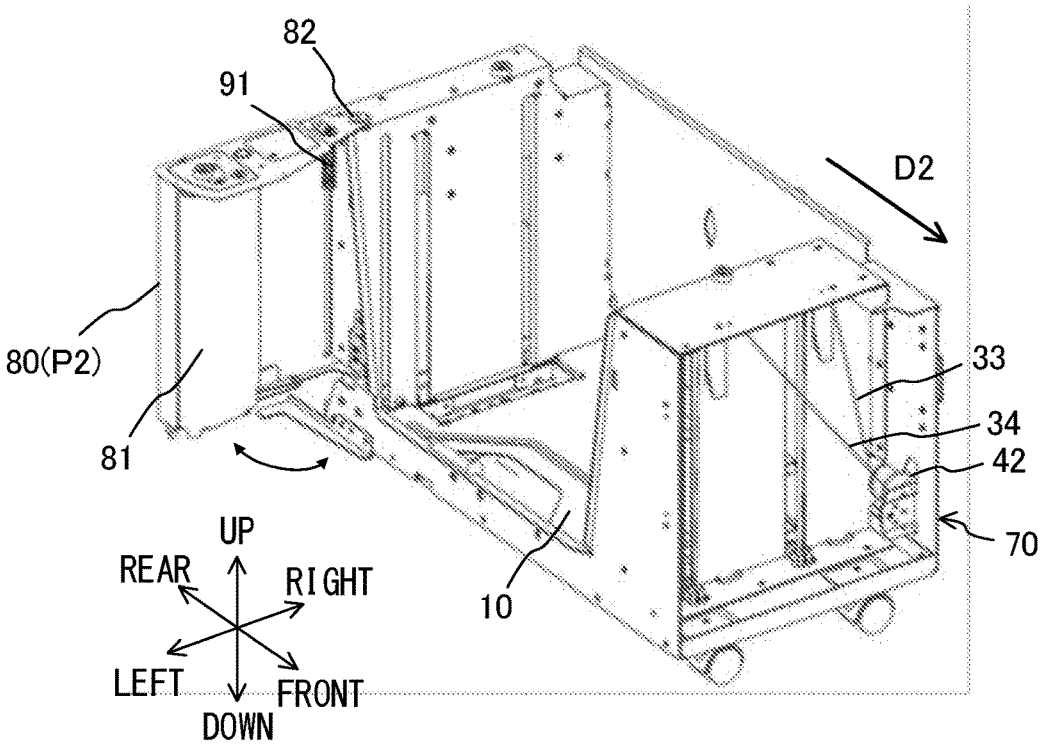
FIG. 8A is a perspective view illustrating a pull-out part in another embodiment (example 1)
Figure 8B:
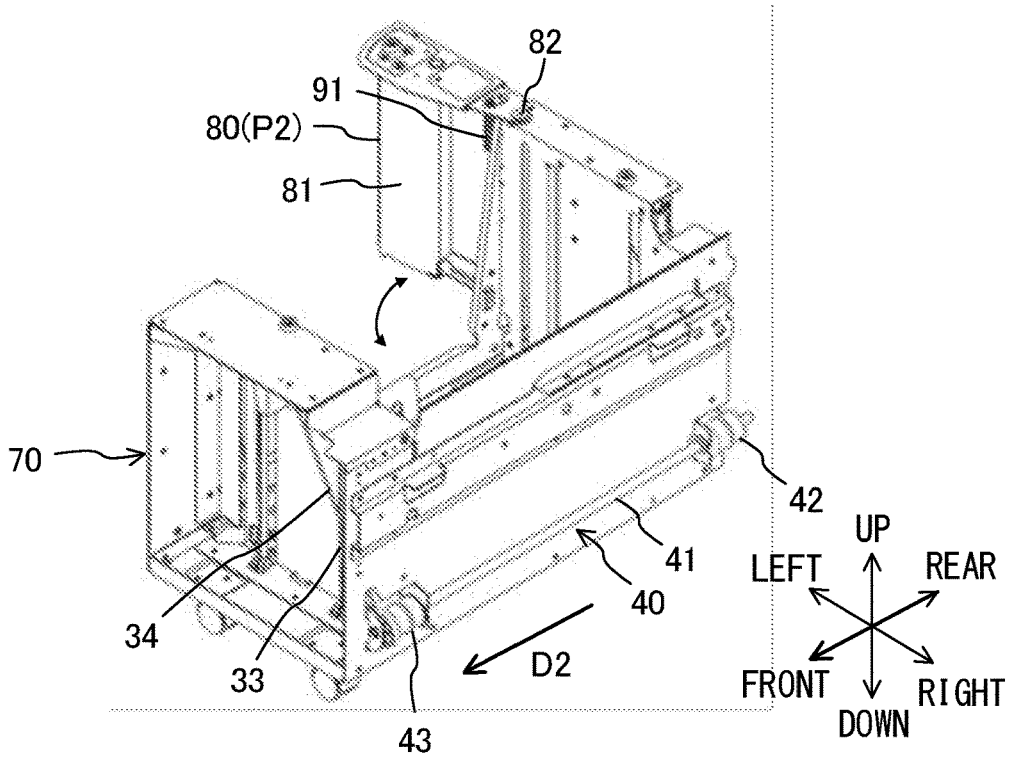
FIG. 8B is a perspective view illustrating a pull-out part in another embodiment (example 2)

FIGS. 8A and 8B are perspective views illustrating a pull-out part 70.

Figure 9:
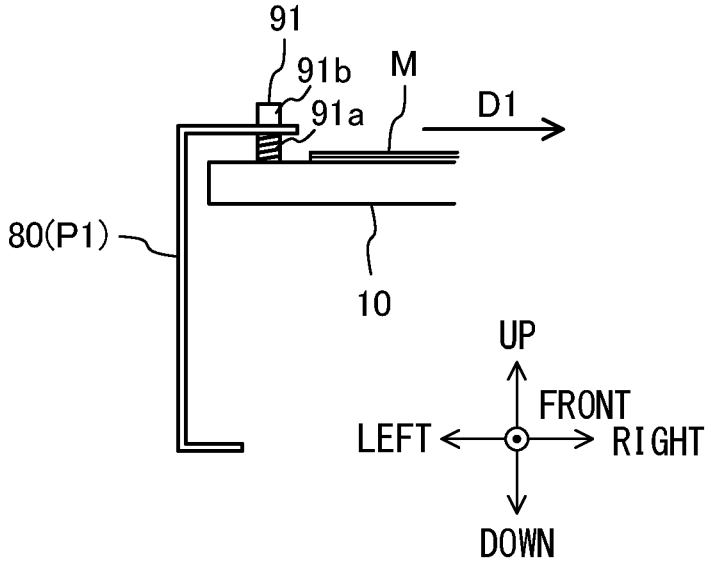
FIG. 9 is a front view for illustrating a load member in another embodiment.

FIG. 9 is a front view for illustrating the load member 91.

As depicted in FIGS. 8A and 8B, the load member 91 is provided at the above-described restriction member 80. FIGS. 8A and 8B illustrate a situation in which the front cover has been removed from the pull-out part 70 depicted in FIG. 3, thereby exposing casters that would be hidden behind the front cover.

When the pull-out part 70 is accommodated within the housing 60, the load member 91 is located at a position where the load member 91 applies a load to the feed tray 10, as depicted in FIG. 9.

When the pull-out part 70 is pulled out of the housing 60 in the pull-out direction D2 (forward direction) as depicted in FIGS. 8A and 8B, the restriction member 80 moves to the open position P2 with the rotating shaft 82 as a rotation center and opens the addition access path (the left side of the feed tray 10) for allowing media M to be added to the feed tray 10. The load member 91 is provided at the restriction member 80, as will be described hereinafter.

As depicted in FIG. 9, a load member 90 includes the elastic member 91*a*, which is, for example, a compression spring, and a core rod 91*b* located inside the elastic member 91*a*. The core rod 91*b* is fixed to an upper portion of the restriction member 80. An upper portion of the elastic member 91*a* is fixed to the core rod 91*b* or an upper portion of the restriction member 80.

The elastic member 91*a* comes into contact with the upper surface of the feed tray 10 when the feed tray 10 is lifted to a predetermined height (see FIG. 9) or greater (an example of a situation in which the amount of media M placed on the feed tray 10 is equal to or smaller than a predetermined amount). When the feed tray 10 comes into contact with the elastic member 91*a* and is further lifted, the elastic member 91*a* is pressed and compressed by the feed tray 10. Thus, the load member 91 applies, by means of the elastic force of the elastic member 91*a*, a downward load to a left edge portion of the feed tray 10 (the upstream side in the draw-out direction), similarly to the load L15 based on the weight of the load member 50 depicted in FIG. 7B described above. Accordingly, the difference between the loads L13 and L14 can be reduced, thereby minimizing the inclination of the feed tray 10.

Figure 10:
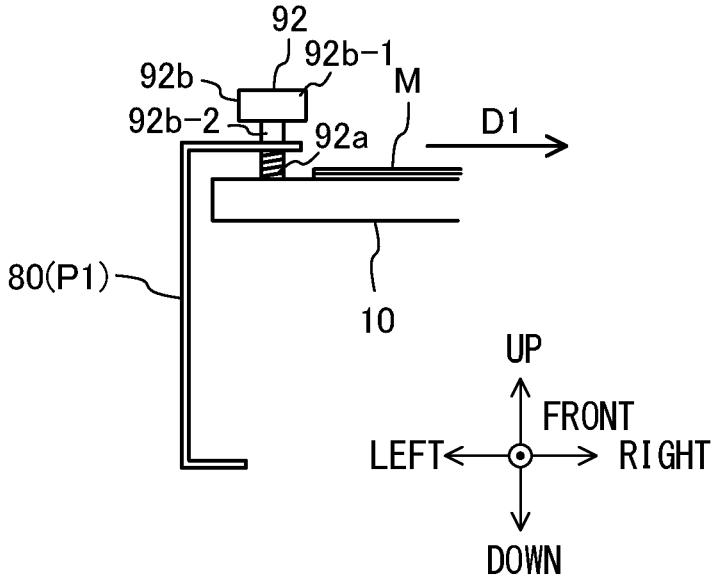
FIG. 10 is a front view for illustrating a load member in a variation of another embodiment.

The load member 91 that includes the elastic member 91*a* may be replaced with a load member 92 that includes an elastic member 92*a* and a weight 92*b*, as seen in the variation illustrated in FIG. 10. The load member 92 is such that the elastic member 92*a*, e.g., a compression spring, is wound upon an axis section 92*b*-2 of the weight 92*b*.

The elastic member 92*a* is positioned to come into contact with the upper surface of the feed tray 10 when the feed tray 10 is lifted to a predetermined height or greater (an example of a situation in which the amount of media M placed on the feed tray 10 is equal to or smaller than a predetermined amount). When the feed tray 10 comes into contact with the elastic member 92*a* and is further lifted, the elastic member 92*a* is pressed and compressed by the feed tray 10, and the weight 92*b* comes into contact with the upper surface of the feed tray 10. When the feed tray 10 comes into contact with the weight 92*b* and is further lifted, the weight 92*b* is raised by the feed tray 10. Thus, the load member 91 can apply, by means of the elastic force of the elastic member 92*a* and the weight of the weight 92*b*, a downward load to a left edge portion of the feed tray 10 (the upstream side in the draw-out direction), similarly to the load L15 based on the weight of the load member 50 depicted in FIG. 7B described above. Accordingly, the difference between the loads L13 and L14 can be reduced, thereby minimizing the inclination of the feed tray 10.

This other embodiment described so far can achieve advantageous effects similar to those in the embodiments described above. In particular, this other embodiment provides the advantageous effect of preventing the feed tray 10 from inclining and minimizing an increase in a load applied to the spooling unit 40 (an example of the drive means) that spools the first to fourth wires 31 to 34, i.e., examples of the hanging member.

In the present embodiment, the load member 91 and the load member 92 in the variation respectively include the elastic members 91*a* and 92*a*, which come into contact with the feed tray 10 when the feed tray 10 is lifted to a predetermined height or greater; and the elastic members 91*a* and 92*a* are pressed and compressed by the feed tray 10 respectively when the feed tray 10 comes into contact with the elastic members 91*a* and 92*a* and is further lifted. Accordingly, while the amount of placed media M is decreasing when the feed tray 10 is in contact with the elastic member 91*a* or 91*b*, i.e., while the upward load L13 resulting from the first wire 31 and third wire 33 located on the downstream side in the draw-out direction D1 is being increasingly concentrated on the feed tray 10 due to a decrease in the downward load resulting from the draw-out rollers 21 and 22, the downward load resulting from the elastic force of the elastic member 91*a* or 92*a* can be increased owing to the compression of the elastic member 91*a* or 92*a*. Hence, the feed tray 10 can be more effectively prevented from inclining.

The load member 92 in the variation includes the elastic member 92*a* and the weight 92*b* and is positioned to come into contact with the feed tray 10 when the feed tray 10 is lifted to a predetermined height or greater. Accordingly, a downward load resulting from the elastic force of the elastic member 92*a* can be applied to the feed tray 10 when the feed tray 10 is in contact with the elastic member 92*a*, and a constant downward load resulting from the weight of the weight 92*b* can be applied to the feed tray 10 when the feed tray 10 is in contact with the weight 92*b*.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of fact, without departing from the gist of the invention. The following indicates, as appendixes, the inventions recited in the claims at the time of filing of the present application.

Appendix 1. A medium feeding apparatus comprising:

a feed tray on which media are placed;

a draw-out unit that draws out an uppermost medium among the media placed on the feed tray;

a hanging member that hangs the feed tray; and a load member that applies, when an amount of the media placed on the feed tray is equal to or smaller than a predetermined amount, a downward load to a portion of the feed tray located on an upstream side in a draw-out direction of the media.

Appendix 2. The medium feeding apparatus of appendix 1, wherein the hanging member is a plurality of line members, the medium feeding apparatus further comprises a spooling unit that spools the plurality of line members, and the load member applies the load to the portion of the feed tray located on the upstream side in the draw-out direction when the feed tray is lifted to a predetermined height or greater as a result of the spooling unit spooling the plurality of line members.

Appendix 3. The medium feeding apparatus of appendix 2, wherein the load member includes a weight positioned to come into contact with the feed tray when the feed tray is lifted to a predetermined height or greater, and the weight is raised by the feed tray when the feed tray comes into contact with the weight and is further lifted.

Appendix 4. The medium feeding apparatus of appendix 2 or 3, wherein the load member includes an elastic member that comes into contact with the feed tray when the feed tray is lifted to a predetermined height or greater, and the elastic member is pressed and compressed by the feed tray when the feed tray comes into contact with the elastic member and is further lifted.

Appendix 5. The medium feeding apparatus of any of appendixes 2-4, further comprising:

a restriction member capable of moving to an open or close position, wherein the restriction member restricts, when being located at the close position, a position of an edge portion of the media placed on the feed tray and opens, when being located at the open position, an addition access path for allowing media to be added to the feed tray, and the load member is provided at the restriction member.

What is claimed is:

1. A medium feeding apparatus comprising:

a feed tray on which media are placed;

a conveyor that draws out an uppermost medium among the media placed on the feed tray;

a hanger that hangs the feed tray; and a load structure that applies, when an amount of the media placed on the feed tray is equal to or smaller than a predetermined amount, a downward load to a portion of the feed tray located on an upstream side in a draw-out direction of the media, wherein the load structure does not apply a load to the portion of the feed tray when the amount of the media placed on the feed tray is greater than the predetermined amount.

2. The medium feeding apparatus of claim 1, wherein the hanger is a plurality of lines, the medium feeding apparatus further comprises a drive that spools the plurality of lines, and the load structure applies the load to the portion of the feed tray located on the upstream side in the draw-out direction when the feed tray is lifted to a predetermined height or greater as a result of the drive spooling the plurality of lines.

3. The medium feeding apparatus of claim 2, wherein the load structure includes a weight positioned to come into contact with the feed tray when the feed tray is lifted to a predetermined height or greater, and the weight is raised by the feed tray when the feed tray comes into contact with the weight and is further lifted.

4. The medium feeding apparatus of claim 3, wherein the load structure includes an elastic structure that comes into contact with the feed tray when the feed tray is lifted to a predetermined height or greater, and the elastic structure is pressed and compressed by the feed tray when the feed tray comes into contact with the elastic structure and is further lifted.

5. The medium feeding apparatus of claim 4, further comprising:

a restriction wall that is movable to an open or close position, wherein the restriction wall restricts, when being located at the close position, a position of an edge portion of the media placed on the feed tray and opens, when being located at the open position, an addition access path to allow media to be added to the feed tray, and the load structure is provided at the restriction wall.

6. The medium feeding apparatus of claim 3, further comprising:

a restriction wall that is movable to an open or close position, wherein the restriction wall restricts, when being located at the close position, a position of an edge portion of the media placed on the feed tray and opens, when being located at the open position, an addition access path to allow media to be added to the feed tray, and the load structure is provided at the restriction wall.

7. The medium feeding apparatus of claim 2, wherein the load structure includes an elastic structure that comes into contact with the feed tray when the feed tray is lifted to a predetermined height or greater, and the elastic structure is pressed and compressed by the feed tray when the feed tray comes into contact with the elastic structure and is further lifted.

8. The medium feeding apparatus of claim 7, further comprising:

a restriction wall that is movable to an open or close position, wherein the restriction wall restricts, when being located at the close position, a position of an edge portion of the media placed on the feed tray and opens, when being located at the open position, an addition access path to allow media to be added to the feed tray, and the load structure is provided at the restriction wall.

9. The medium feeding apparatus of claim 2, further comprising:

a restriction wall that is movable to an open or close position, wherein the restriction wall restricts, when being located at the close position, a position of an edge portion of the media placed on the feed tray and opens, when being located at the open position, an addition access path to allow media to be added to the feed tray, and the load structure is provided at the restriction wall.

* * * * *